US005929727A

United States Patent [19]

Kagata et al.

[11] Patent Number: 5,929,727

[45] Date of Patent: Jul. 27, 1999

[54] DIELECTRIC RESONATOR, METHOD FOR MANUFACTURING THE SAME, FILTER AND COMMUNICATION APPARATUS

[75] Inventors: Hiroshi Kagata, Hirakata; Tatsuya Inoue, Takatsuki; Junichi Kato, Osaka; Hiroshi Sogo, Nishinomiya, all of Japan

[73] Assignee: Matsushita Electric Industrial Co., Ltd., Osaka, Japan

[21] Appl. No.: 08/947,739

[22] Filed: Oct. 10, 1997

[30] Foreign Application Priority Data

Oct. 11, 1996 [JP] Japan ..... 8-269651

[51] Int. Cl.[6] ..... H01P 7/04

[52] U.S. Cl. ..... 333/222; 333/219

[58] Field of Search ..... 333/202, 206, 333/207, 222, 223, 219.1, 219

[56] References Cited

U.S. PATENT DOCUMENTS 5,783,978 7/1998 Noguchi et al. ..... 333/206 X
5,841,332 11/1998 Hino ..... 333/207

FOREIGN PATENT DOCUMENTS 3-254513 11/1991 Japan .

*Primary Examiner*—Seungsook Ham
*Attorney, Agent, or Firm*—Ratner & Prestia

[57] ABSTRACT

A coaxial dielectric resonator which is prismatic and has a through hole in a vertical direction, has such feature that each base side of said prism being no more than 1.6 mm, a diameter of said through hole being no more than 0.8 mm, said coaxial dielectric resonator having an electrode portion on a surface thereof and on an inner surface of said through hole.

4 Claims, 4 Drawing Sheets

DIELECTRIC RESONATOR, METHOD FOR MANUFACTURING THE SAME, FILTER AND COMMUNICATION APPARATUS

BACKGROUND OF THE INVENTION

1. Field of the Invention

The present invention relates to a coaxial dielectric resonator used for a high-frequency filter in a communication apparatus such as a mobile communication apparatus and a personal handy phone system (PHS), and more particularly, to a small size coaxial dielectric resonator and a method for manufacturing the same.

2. Related Art of the Invention

In recent years, with the development of the mobile communication and the PHS typified by portable telephones, various apparatuses have been remarkably reduced in size. Of the parts constituting the apparatuses, a dielectric filter in which a coaxial dielectric resonator is combined is comparatively large in size and there is a strong demand that the dielectric filter be reduced in size. To meet the demand, as disclosed in Japanese Laid-open Patent Application H3-254513, a laminated filter has come to be used which is manufactured by laminating dielectric green sheets having conductive paste printed thereon and sintering the lamination. Although advantageous in size reduction, the laminated filter is not satisfactory in characteristics such as insertion loss and out-of-band attenuation. Because of the disadvantage in characteristics of the laminated filter, a dielectric filter using a coaxial resonator is widely used although the size is greater.

FIG. 1 shows the structure of a coaxial dielectric resonator. To manufacture the coaxial dielectric resonator, dielectric powder is filled into a metal cast and pressurized and the obtained compact is sintered, and then, a conductor is formed on a necessary portion on the surface. Here, reference numeral 1 represents a dielectric having its surface metallized and reference numeral 2 represents a through hole.

However, by such dry pressing of powder, pressure cannot be uniformly applied, so that there is a limit in size reduction. Therefore, conventional coaxial dielectric resonators are approximately 1.8 mm square at the minimum.

As described above, although there is a strong demand that the coaxial dielectric resonator be reduced in size, a very small size resonator, for example, a resonator 1.6 mm square or smaller cannot be manufactured according to the conventional manufacturing method. Such a very small size coaxial resonator is strongly demanded because if such a resonator is realized, a dielectric filter will be obtained which is as small in size as the laminated filter but has more excellent characteristics.

SUMMARY OF THE INVENTION

In view of such a problem of the conventional coaxial dielectric resonator, an object of the present invention is to provide a coaxial dielectric resonator being very small in size and having satisfactory characteristics.

A coaxial dielectric resonator of the present invention being prismatic and having a through hole in a vertical direction, is such that each base side of said prism being no more than 1.6 mm, a diameter of said through hole being no more than 0.8 mm, said coaxial dielectric resonator having an electrode portion on a surface thereof and on an inner surface of said through hole.

A method of the present invention for manufacturing a coaxial dielectric resonator being prismatic and having a through hole in a vertical direction, is such that a bar for forming said through hole is placed on a lamination of a predetermined number of dielectric ceramic green sheets, and after a predetermined number of said ceramic green sheets are laminated thereon, pressing is performed, and after said bar is taken out, sintering is performed.

A method of the present invention for manufacturing a coaxial dielectric resonator being prismatic and having a through hole in a vertical direction, is such that a resin- or carbon-made bar for forming said through hole is placed on a lamination of a predetermined number of dielectric ceramic green sheets, and after a predetermined number of said dielectric ceramic green sheets are laminated thereon, pressing is performed, heating is performed to remove a component of said bar and then, sintering is performed.

A method of the present invention for manufacturing a coaxial dielectric resonator being prismatic and having a through hole in a vertical direction, is such that a bar for forming said through hole, the bar of which has applied to its surface a conductive paste of gold, silver, copper, an alloy having gold as a main component , an alloy having silver as a main component or an alloy having copper as a main component, is placed on a lamination of a predetermined number of dielectric ceramic green sheets, and after a predetermined number of said dielectric ceramic green sheets are laminated thereon, pressing is performed, and after said bar is taken out, sintering is performed.

A method of the present invention for manufacturing a coaxial dielectric resonator being prismatic and having a through hole in a vertical direction, is such that a resin- or carbon-made bar for forming said through hole which bar has applied to its surface a conductive paste of gold, silver, copper, an alloy having gold as a main component, an alloy having silver as a main component or an alloy having copper as a main component is placed on a lamination of a predetermined number of dielectric ceramic green sheets, and after a predetermined number of said dielectric ceramic green sheets are laminated thereon, pressing is performed, heating is performed to remove a component of said bar and then, sintering is performed.

DESCRIPTION OF THE DRAWING

Figure 1:
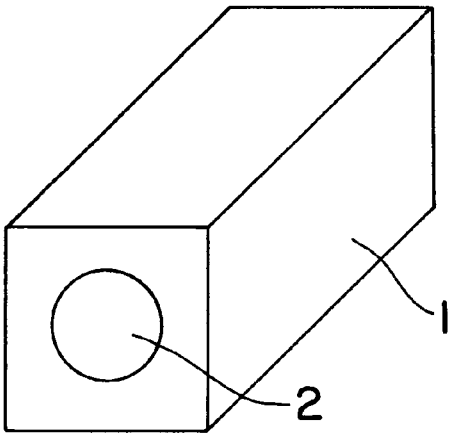
FIG. 1 is a perspective view showing an appearance of an example of a conventional dielectric resonator.

1 Dielectric
2 Through hole
3 Ceramic green sheet
4 Bar
5 Ceramic sheet
6 Metal cast with protrusions Embodiment of the Invention Hereinafter, an embodiment of the present invention will be described with reference to the drawings.

As the dielectric ceramic material for the present invention on, although the composition is not specifically limited, materials are desirable which are high in Q value at high frequency and small in temperature coefficient of the resonant frequency such as Ba—Nd—Ti—Bi—O series, BaO—$TiO_2$ series, $Bi_2O_3$—$Nb_2O_5$ series and $MgTiO_3$—$CaTiO_3$ series. The previously-mentioned dielectric powder is blended with a solvent, a binder and a plasticizer into a slurry. As the solvent, water, ester series and alcohol series are desirable. As the binder, polyvinyl butyral series and acrylic series are desirable. The slurry is casted to obtain a dielectric green sheet. As the casting method, the doctor blade method and the reverse roll method are desirable. The thickness of the green sheet is preferably 5 to 1000 $\mu$m.

After a predetermined number of green sheets are laminated, positions where bars for forming through holes are placed are lightly pressurized (desirably, within a range of 10 to 300 kg/cm$^2$) by a cast having protrusions to form grooves. Although not specifically limited, the configuration of the grooves is preferably a V shape, a U shape or an inverted U shape. Then, the through hole forming bar is placed in each groove. It is needless to say that the grooves are not necessarily formed.

As the material for the through hole forming bar, metal, resin and carbon (carbon powder casted into a bar shape) are desirable. Moreover, conductive paste of gold, silver, copper, an alloy having gold as a main component, an alloy having silver as a main component or an alloy having copper as a main component may be formed on the surface of the through hole forming bar. As the method for forming the conductive paste, the dipping method is desirable.

Then, after a predetermined number of green sheets are further laminated on the lamination of green sheets on which the through hole forming bars are placed, pressing is performed. In the case of uniaxial pressurizing, the pressure is desirably 50 to 1000 kg/cm$^2$ and the temperature is desirably room temperature to 200° C. In the case of hydrostatic pressure, the pressure is desirably 200 to 10000 kg/cm$^2$ and the temperature is desirably room temperature to 100° C.

Then, the through hole forming bars are taken out and the lamination is cut into pieces. This may be performed after sintering. After heat treatment is performed at 300 to 800° C. to remove the organic components, sintering is performed at 800 to 1600° C. When resin- or carbon-made bars are used, it is unnecessary to take out the bars because they are removed by heating.

The sintered lamination pieces thus formed are chamfered by a barrel and an external conductor is formed. As the external conductor, a conductor is desirable which has a high conductivity such as gold, silver, copper and alloys thereof. As the method for forming the conductor, printing, coating, dipping and evaporation are desirable. In the case of the $\lambda/4$ resonator, one of the bottom surfaces is ground and in the case of $\lambda/2$ resonator, both of the bottom surfaces are ground.

A small size coaxial dielectric resonator is obtained in the manner described above. The Q value of the resonator is measured by use of a network analyzer.

Hereinafter, embodiments of the present invention will be described with reference to the drawings.

(First Embodiment)

As the dielectric ceramics, Ba—Nd—Ti—Bi—O series with a dielectric constant of 95 and $Bi_2O_3$—CaO—$Nb_2O_5$ with a dielectric constant of 58 were used. To one hundred parts by weight of dielectric ceramic powder, five parts by weight of polyvinyl butyral resin as the binder, 2.5 parts by weight of benzyl butyl phthalate as the plasticizer and 60 parts by weight of butyl acetate as the solvent were added, and these materials were blended for 40 hours together with a zirconia-made ball with a diameter of 10 mm to obtain slurry. The slurry was casted into a green sheet with a thickness of 0.14 mm by the doctor blade method. Six of the green sheets 3 were laminated as shown in FIG. 2(*a*). Then, as shown in FIG. 2(*b*), through hole forming bars 4 with a diameter of 5 mm were placed. As the through hole forming bars 4, various types were used as shown in Table 1. On the bars 4, six of the green sheets 3 were laminated as shown in FIG. 2(*c*) and pressing was performed at 60° C. at a pressure of 300 kg/cm$^2$ to obtain a lamination 5 as shown in FIG. 2(*d*).

Then, the through hole forming bars 4 were not taken out when they were made of resin or carbon, and were taken out when they were made of other materials which cannot be removed by heating.

Then, the lamination was cut into pieces as shown in FIG. 2(*e*).

Then, the organic components in the green sheets and the paste were removed by holding the lamination piece at 600° C. for five hours. When the through hole forming bars 4 had not been taken out, the components thereof were removed.

Then, in the case of the Ba—Nd—Ti—Bi—O series, the lamination piece was held at 1300° C. for two hours and in the case of the $Bi_2O_3$—CaO—$Nb_2O_5$ series, after held at 900° C. for two hours, the lamination piece was sintered.

Figure 4A:
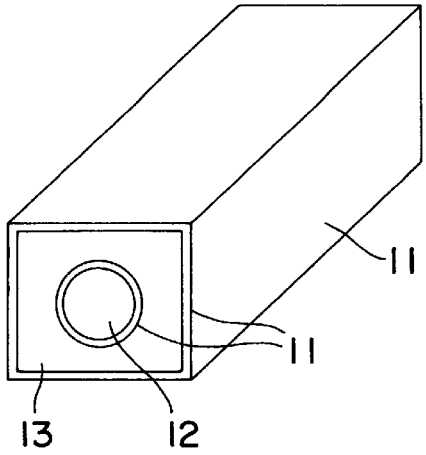
FIGS. 4(*a*)–(*c*) are cross-sectional views showing still another embodiment of the method for manufacturing a dielectric resonator according to the present invention.
Figure 4B:
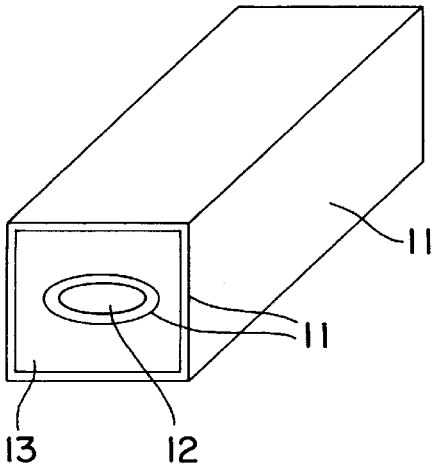
Figure 4C:
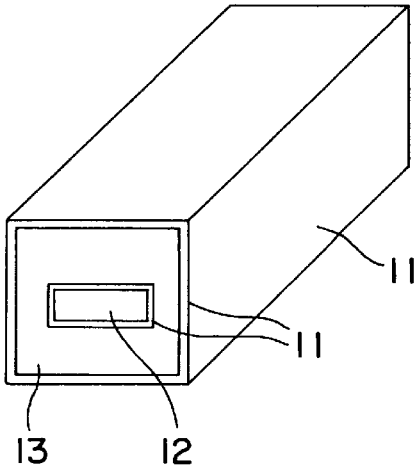

Then, after the sintered lamination piece was chamfered by the barrel method, dipping and baking of Ag paste were repeated four times to form a conductor on the surface of the sintered lamination piece. The open surface thereof was ground and a coaxial dielectric resonator as shown in FIG. 4(*a*) was obtained. Here, reference numeral 11 represents a conductor, reference numeral 12 represents a through hole and reference numeral 13 represents dielectric ceramics. The size was 1.3 mm by 1.3 mm by 5.0 mm. It is natural that with this, a coaxial dielectric resonator with a base side of 1.6 mm or smaller and a diameter of the through hole of 0.8 mm or smaller which resonator has a size greater than the above-mentioned size and could not be manufactured by the conventional method should be manufacturable according to the present invention.

The Q value of the resonator of 1.3 mm by 1.3 mm by 5.0 mm manufactured in the manner described above was measured by a network analyzer. The results are shown in Table 1. Two hundred resonators were manufactured under various conditions and as the characteristics, average values were shown.

TABLE 1

| | Corresponding | | Through Hole | Characteristics of Coaxial Resonator | |
|---|---|---|---|---|---|
| No. | Invention | Dielectric | Forming Bar | $f_0$(GHz) | Q Value |
| 1 | 2 | A | Steel | 1.53 | 110 |
| 2 | 2 | B | Steel | 1.97 | 115 |
| 3 | 3 | B | Resin | 1.96 | 110 |
| 4 | 3 | B | Carbon | 1.96 | 118 |
| 5 | 4 | A | Ag paste applied steel | 1.52 | 112 |
| 6 | 4 | B | Au paste applied steel | 1.99 | 110 |
| 7 | 5 | B | Ag paste applied resin | 1.98 | 111 |
| 8 | 5 | B | Cu paste applied carbon | 1.99 | 108 |

A: Ba-Nd-Ti-Bi-O series
B: $Bi_2O_3$-CaO-$Nb_2O_5$ series

From Table 1, it is apparent that according to the present invention, an unprecedentedly small size coaxial dielectric resonator which is 1.3 mm square is manufactured and the resonator has a satisfactory Q value.

By forming the conductor inside the through hole in such a manner that conductive paste is previously applied to the through hole forming bars, the bars are sandwiched between the dielectric green sheets and pressing is performed as described above, the conductor inside the through hole may be efficiently formed so as to be sufficiently thick.

(Second Embodiment)

FIG. 3 shows a method for forming grooves in a dielectric green sheet in a second embodiment.

As the dielectric ceramics, Ba—Nd—Ti—Bi—O series with a dielectric constant of 95 was used. First, six green sheets 7 were laminated which were formed in a similar manner to the first embodiment. Against the laminated green sheets 7, a metal cast 6 with V-shaped protrusions shown in FIG. 3 was pressed at a pressure of 50 kg/cm$^2$ to form grooves (FIGS. 3(*a*), 3(*b*) and 3(*c*)). In each of the V-shaped grooves, a metal bar 9 for forming a through hole was placed (FIGS. 3(*c*) and 3(*d*)) and six green sheets 7 were placed thereon (FIG. 3(*e*)). Then, pressing was performed in a manner similar to the first embodiment (FIG. 3(*f*)) to obtain a coaxial dielectric resonator 10.

The rate of crack generation when 200 coaxial dielectric resonators were manufactured by the method described above was 1.5% which was ⅕ or lower than the rate when the resonators were manufactured by the normal method. The characteristics such as the Q value were similar. According to this method, since the grooves were previously formed in the green sheets, undue stress was not readily applied to the green sheets in the periphery of the through hole forming bars at the time of pressing, so that defects such as cracks were not readily caused.

In the coaxial dielectric resonators thus manufactured, the through hole may be elliptical or polygonal instead of being circular and a protrusion may be present in at least two positions at the cross sectional configuration thereof. The reason therefor is that according to the manufacturing method of the present invention, since the through hole is formed by sandwiching the bar between the green sheets and performing pressing, space can be formed in one position on each of the left and right sides thereof. The protrusions may be effectively used.

Figure 5:
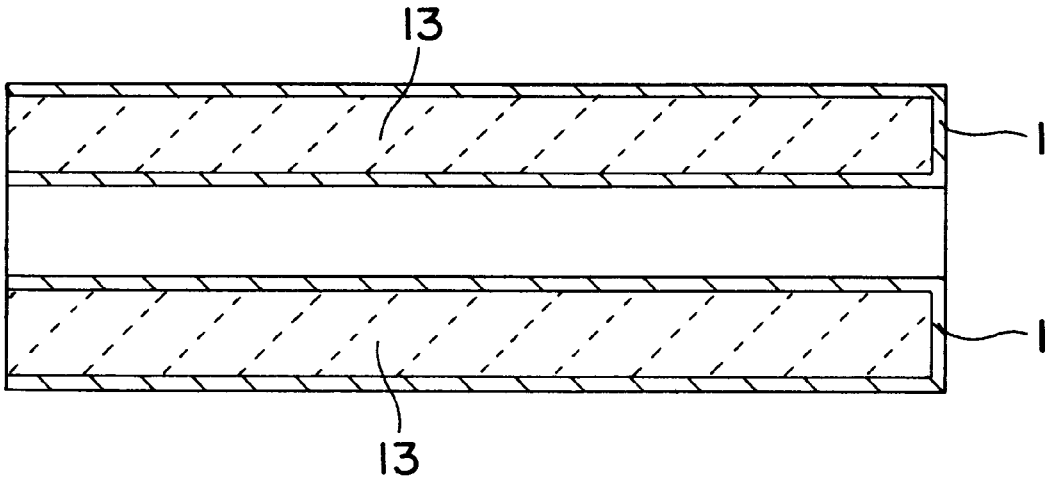
FIG. 5 is a longitudinal cross-sectional view of FIG. 4(*a*).
Figure 2A:
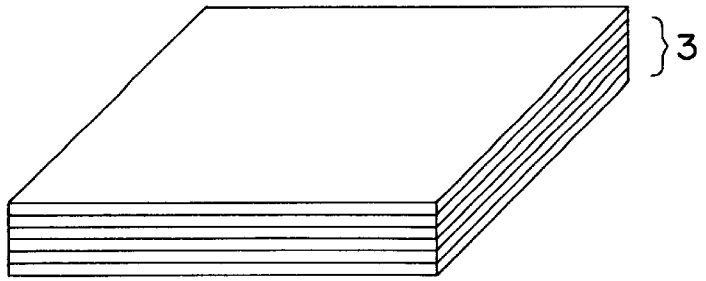
FIGS. 2(*a*)–2(*e*) are perspective views showing an embodiment of a method for manufacturing a dielectric resonator according to the present invention.
Figure 2B:
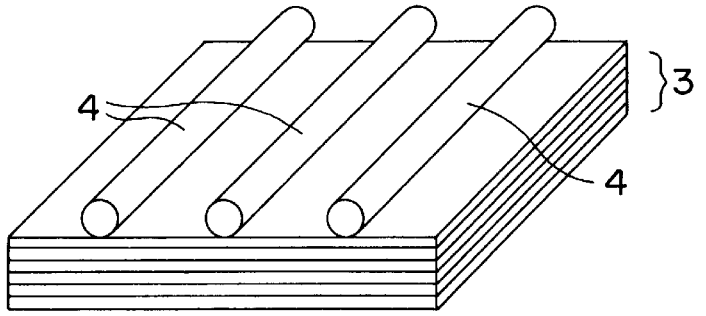
Figure 2C:
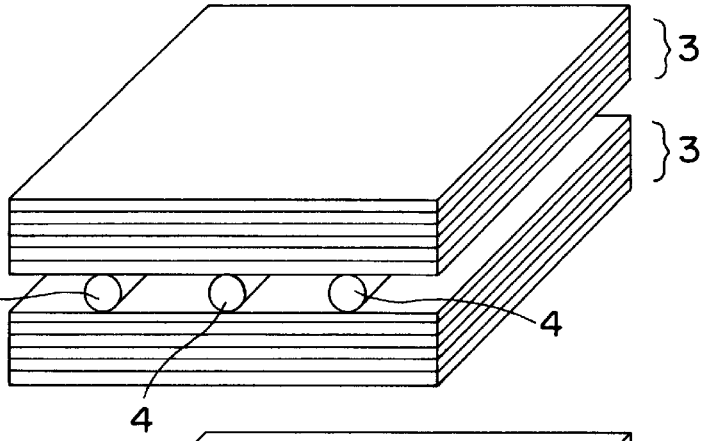
Figure 2D:
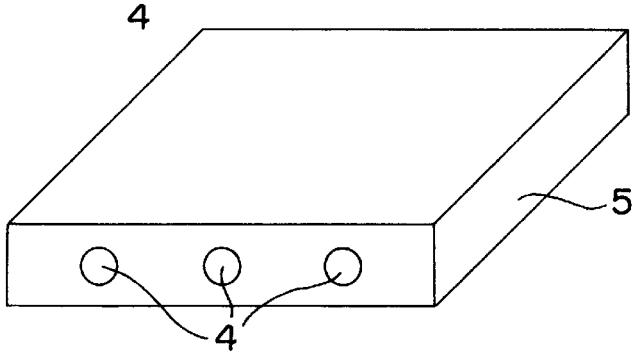
Figure 2E:
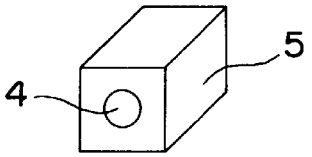
Figure 3A:
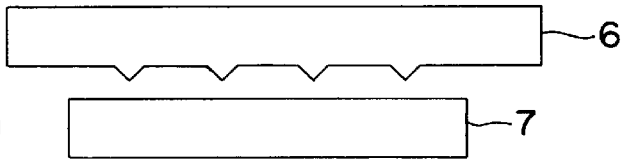
FIGS. 3(*a*)–3(*f*) are cross-sectional views showing another embodiment of the method for manufacturing a dielectric resonator according to the present invention.
Figure 3B:
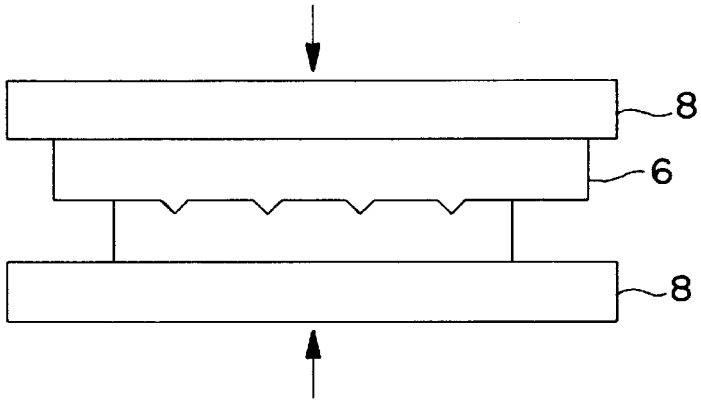
Figure 3C:
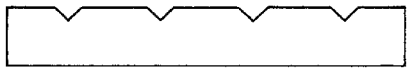
Figure 3D:
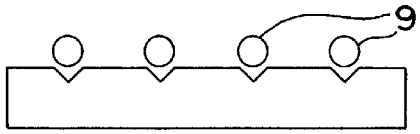
Figure 3E:
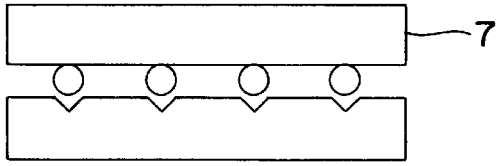
Figure 3F:
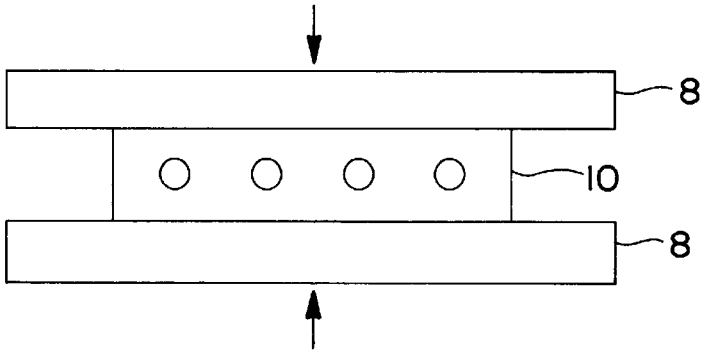

FIGS. 4(*b*) and 4(*c*) are perspective views showing modifications of the coaxial dielectric resonator. FIG. 4(*b*) is illustrative of the case of an elliptical through hole and FIG. 4(*c*) is illustrative of the case of a rectangular through hole. Reference numeral 11 represents the conductor. Reference numeral 12 represents the through hole. Reference numeral 13 represents the dielectric ceramics. FIG. 5 is a longitudinal cross-sectional view of FIG. 4(*a*).

The very small size coaxial dielectric resonator thus manufactured may be applied to a high-frequency filter, and are most suitable for the mobile communication and the PHS provided with an antenna, a speaker, a microphone, an amplifier and an oscillator, etc.

As is apparent from the description given above, according to the present invention, a very small size coaxial dielectric resonator may be manufactured which could not be manufactured by the conventional method.

In addition, by previously forming the grooves in the green sheets, the generation of cracks is restrained.

What is claimed is:

1. A coaxial dielectric resonator being prismatoid and having a through hole in a vertical direction, each base side of said prismatoid being no more than 1.6 mm, a diameter of said through hole being no more than 0.8 mm, said coaxial dielectric resonator having an electrode portion on a surface thereof and on an inner surface of said through hole.

2. A coaxial dielectric resonator according to claim 1, wherein a cross-sectional configuration of said through hole is circular, elliptical or polygonal, and a protrusion is present in at least two positions at the cross-sectional configuration.

3. A filter using a coaxial dielectric resonator being prismatoid and having a through hole in a vertical direction, each base side of said prismatoid being no more than 1.6 mm, a diameter of said through hole being no more than 0.8 mm, said coaxial dielectric resonator having an electrode portion on a surface thereof and on an inner surface of said through hole.

4. A communication apparatus using a coaxial dielectric resonator being prismatoid and having a through hole in a vertical direction, each base side of said prismatoid being no more than 1.6 mm, a diameter of said through hole being no more than 0.8 mm, said coaxial dielectric resonator having an electrode portion on a surface thereof and on an inner surface of said through hole.

* * * * *